US005244417A

United States Patent [19]

Perretta et al.

[11] Patent Number: 5,244,417

[45] Date of Patent: Sep. 14, 1993

[54] BACKSHELL INTERFACE SYSTEM

[76] Inventors: Frederick A. Perretta, 315 Aspetuck Trail, Huntington, Conn. 06484; Edward A. Stabile, 183 Putting Green Rd., Trumbull, Conn. 06611

[21] Appl. No.: 998,221

[22] Filed: Dec. 30, 1992

[51] Int. Cl.[5] ..... H01R 13/648

[52] U.S. Cl. ..... 439/610; 439/76

[58] Field of Search ..... 439/76, 98, 607, 610, 439/609, 99

[56] References Cited

U.S. PATENT DOCUMENTS

| | | | |
|---|---|---|---|
| 3,660,728 | 5/1972 | Carter | 439/76 |
| 4,243,290 | 1/1981 | Williams | 439/610 |
| 4,830,628 | 5/1989 | Dyson et al. | 439/610 |

FOREIGN PATENT DOCUMENTS

| | | | |
|---|---|---|---|
| 872449 | 6/1971 | Canada | 439/98 |
| 881013 | 11/1961 | United Kingdom | 439/98 |

*Primary Examiner*—Gary F. Paumen

[57] ABSTRACT

Multi-conductor strand wiring harnesses are connected together by a backshell having several internal semi-flexible circuit boards disposed therein. A minimal non-shielded conductor window is provided between the inlet and outlet connections in the backshell. The system allows interconnections between round and flat connector pin arrays. The use of multiple circuit boards in the backshell allows a multiplicity of inlet to outlet connections to be made, and also reduces the size and weight of the backshell assembly. Right angle connections are readily made in a minimal spatial envelope.

9 Claims, 2 Drawing Sheets

BACKSHELL INTERFACE SYSTEM

TECHNICAL FIELD

This invention relates to electrical connector assemblies and more particularly to a compact, lightweight backshell assembly which can interconnect multiple conductor harnesses with each other.

BACKGROUND ART

Multiple conductor wire harnesses in aircraft, for example, are presently interconnected by means of insulated structures called "backshells". Present day backshells are bulky and relatively heavy structures which require one-to-one conductor connections between the inlet and outlet portions of the backshell. These backshells also do not provide efficient conductor-to-conductor EMI shielding, inside of the backshell, since the non-shielded conductors extend within the backshell from the inlet to the outlet. Excessive cross-talk or inter-conductor noise can thus occur within the backshells of the prior art, especially with high power transmission lines.

Since the wire harnesses have an outer bundle EMI shield which insulates the entire conductor bundle, and inner individual conductor EMI shields, both of which must be stripped and grounded before the conductor wires enter the backshell, the unshielded wires will necessarily be vulnerable to EMI noise inside of the backshell although they will be shielded by the backshell from ambient surroundings. Conductors which must be protected from noise of any kind thus cannot be interconnected by the prior art back-shells, as they exist at the present time. The prior art backshells are also lengthy, and increase in length the more conductors are fed into them.

DISCLOSURE OF THE INVENTION

This invention relates to an improved conductor bundle harness backshell connector assembly which provides for improved conductor EMI shield grounding so that a minimal unshielded conductor window exists in the assembly. The connector assembly includes a backshell housing, which is electrically grounded to the aircraft, or the like. The outer bundle shield is grounded to the backshell by means of a first conductive ferrule assembly which telescopes under the stripped outer insulation shield and over the inner shielded conductor wires.

The inner individual conductor shields are grounded to the backshell by means of a ground ring which telescopes under the inner conductor shields and under the ferrule assembly. The telescoping ferrule assembly and ground ring enable the shielding to be grounded to the backshell in a minimal spatial envelope. The unshielded insulated conductor wires are separated and fed from the ground ring through one wall of the backshell. Once inside of the backshell, the conductor wires are stripped and connected to semi-flexible circuit boards which are contained in the backshell. The circuit boards are operable to shield the individual wires from EMI noise which emanates from the other conductor wires in the bundle. The unshielded portion of conductor wires between the ground ring and the circuit boards is therefore minimized; and the degree of interconductor wire EMI noise is also minimized. The use of the semi-flexible circuit boards inside of the backshell enables the size and weight of the backshell to be significantly reduced, and greatly increases the versatility of the interface system. The boards in the backshell also allow FM, HF, VHF and LF signal conductors to be connected by the interface system of this invention.

It is therefore an object of this invention to provide an improved backshell interface system for interconnecting conductor wire harnesses in aircraft or the like.

It is an additional object of this invention to provide an interface system of the character described which minimizes interconductor wire EMI interference.

It is a further object of this invention to provide an interface system of the character described which is of minimal size and weight.

It is another object of this invention to provide an interface system of the character described which allows round-to-rectangular harness interconnections.

These and other objects and advantages of the invention will become more readily apparent from the following detailed description of the preferred embodiment of the invention when taken in conjunction with the accompanying drawings in which:

BEST MODE FOR CARRYING OUT THE INVENTION

Figure 2:
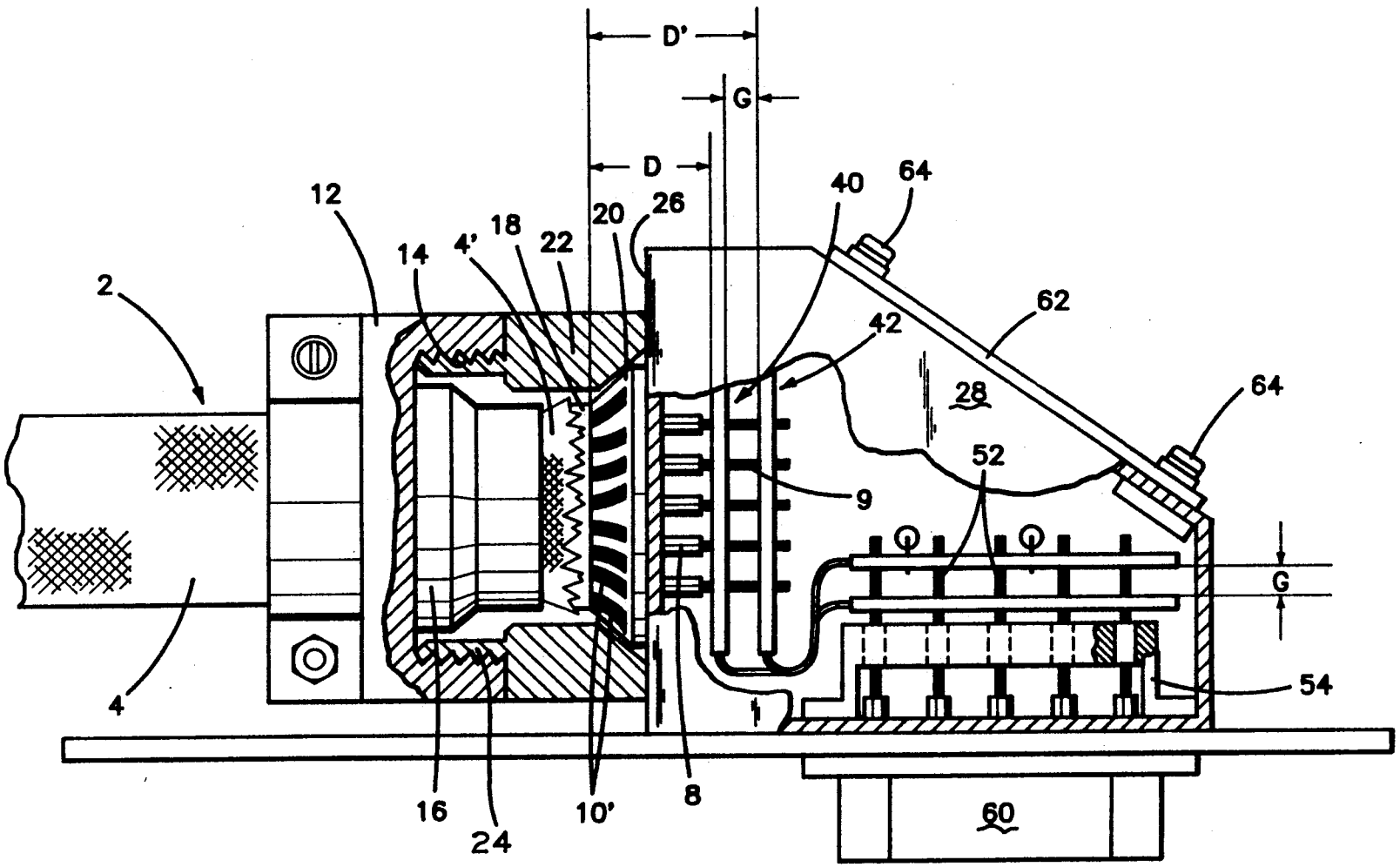
FIG. 2 is a side elevational view of the assembled system of FIG. 1 shown partially in section.

Referring now to FIGS. I and 2, there is shown a preferred embodiment of a backshell interface system formed in accordance with this invention which interconnects a round wire harness to a rectangular wire harness, wherein the interconnected harnesses extend at right angles to each other. The round wire harness is denoted generally by the numeral 2 and includes an outer EMI bundle shield 4 which shields the conductor wire bundle 6 from ambient EMI. Additionally, the individual conductor wires 8 each has its own EMI shield 10 which serves to protect the individual conductor wires from EMI emanating from others of the conductor wires in the bundle 6. The harness 2 passes through a strain relief member 12 which has an internally threaded counterbore 14. The harness 2 and the outer shield 4 then pass through an outer conductive ferrule 16 which telescopes into the threaded counterbore 14 of the member 12. Once past the outer ferrule 16, the outer shield 4 is stripped away from the bundle 6, as at 4', and the individually shielded wires 8 are passed through an inner conductive ferrule 18 which is slid beneath the stripped outer shield 4' and into the outer ferrule 16, as best seen in FIG. 2.

After the conductor bundle 6 passes through the inner ferrule 18, the individual shields 10 are stripped off of the individual wires 8, as at 10', and the insulated but unshielded conductor wires 8 are fed through a tapered inner shield ground ring 20. The stripped inner shields 10' are laid against the outer surface of the ground ring 20, as best shown in FIG. 2. It will be noted that the tapered nose of the ground ring 20 telescopes inside of the inner ferrule 18, as is also best shown in FIG. 2. The shield grounding assembly, i.e., the outer ferrule 16, inner ferrule 18 and ground ring 20 is thus a mutually telescoping assembly which occupies a minimal spatial envelope. The assembly also includes a ground ring housing 22 with an integral annular externally threaded boss 24 which screws into the threaded counterbore 14, as shown in FIG. 2. It will be noted from FIG. 2 that the ferrules 16 and 18 as well as the ground ring 20 are all telescoped inside of the housing 22. The individual stripped inner shields 10' are all tightly sandwiched between the outer tapered surface of the ground ring 20 and an inner complimentarily tapered surface 24 in the housing 22.

Figure 1:
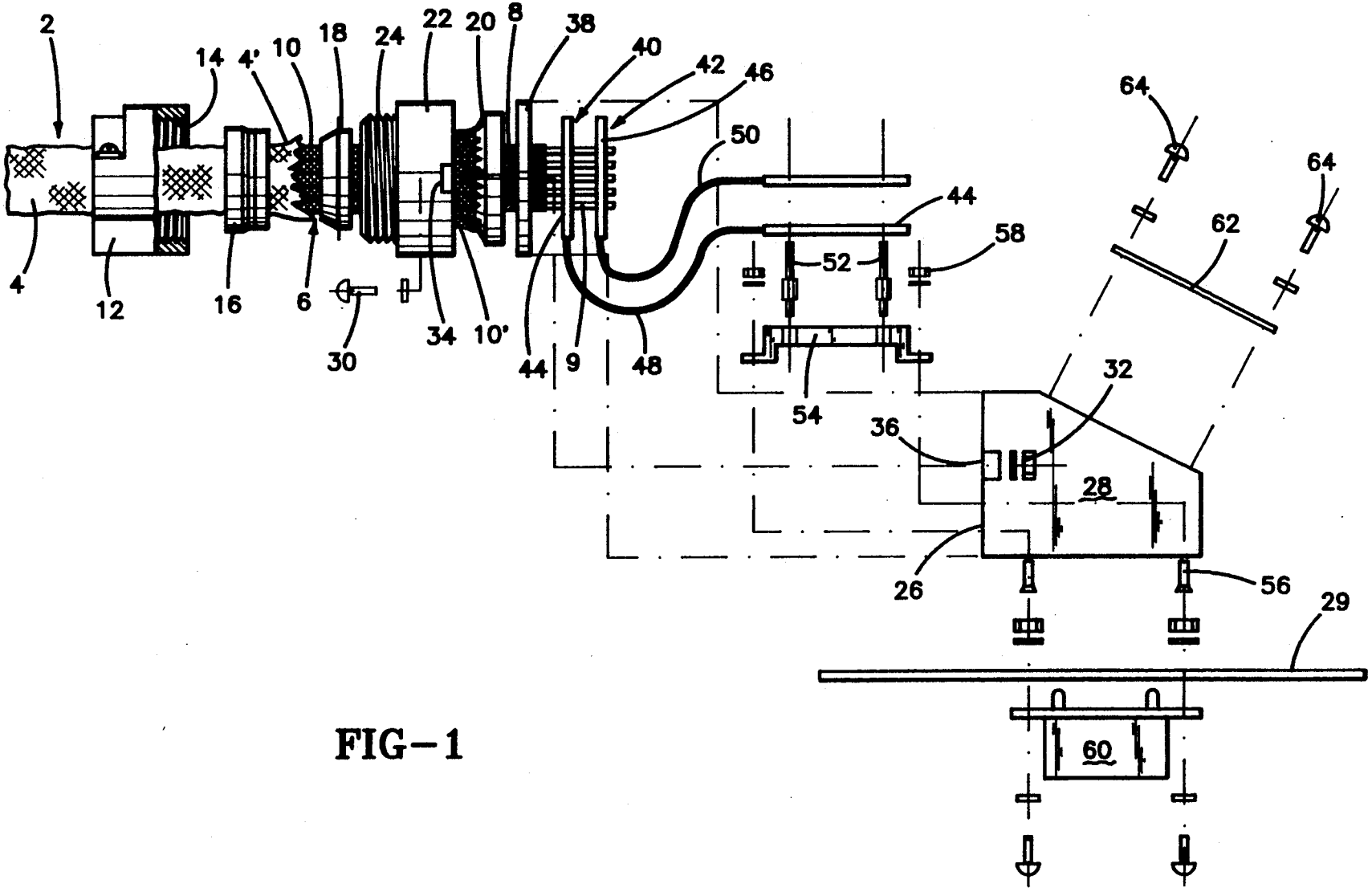
FIG. 1 is an exploded view partly in section of a preferred embodiment of a right angle backshell interface system formed in accordance with this invention.

The housing 22 is securely attached to the front face 26 of the backshell 28 by means of screws 30 and nuts 32 which engage flanges 34 and 36 on the housing 22 and backshell 28, respectively (see FIG. 1). The backshell 28 is mounted on a rack plate 29 which provides a ground to the aircraft or other environment in which the connection is made. If desired, a pressure plate 38 may be sandwiched between the housing 22 and the backshell 28. The insulated individual wires 8 are fed through an opening into the interior of the backshell 28, where the insulation is stripped off and the bare wires 9 are soldered to one or more semi-flexible circuit boards 40 and 42 disposed in the backshell 28. The wires 9 may each be connected to one or more than one of the circuit boards 40 and 42. Each of the boards 40 and 42 has rigid end portions 44 and 46, respectively, where the bare conductor wire connections are made, and a flexible mid portion 48 and 50 which provide a high degree of flexibility and compressibility to the interface system. As noted in the drawings, the boards 40 and 42 permit the formation of a right angle harness-to-harness interconnection. The telescoping shield grounding assembly results in minimal unshielded conductor windows D and D', which can be as small as ⅛" and 3/16", respectively.

The boards 40 and 42 are connected to a plurality of conductor sockets or pins 52 which are mounted on a plug interface 54 which is secured to the inside of the backshell 28 by a plurality of screws 56 and nuts 58. A connector 60 is secured to the outside of the backshell 28 and is electrically connected to the sockets or pins 52. The connector 60 may be round or rectangular. In the embodiment shown in FIG. 2, the harness 2 is round and the connector 60 is rectangular. The rigid pin-connecting ends 44 and 46 are spaced apart inside of the backshell 28 by a distance G, which is preferably about ¼" so as to help in preventing the circuit board connections from overheating. The back-shell 28 is provided with a closure plate 62 which is removably connected to the backshell by screws 64. The closure plate 62 can be removed from the backshell 28 to allow maintenance of the boards 40 and 42. Additionally, the boards 40 and 42 can be removed from the backshell through the opening covered by the panel 62, and replaced with differently wired boards. The interface can thus be easily maintained, upgraded, and changed merely by changing the boards inside of the backshell.

It will be readily appreciated that the interface assembly of this invention is very compact and lightweight and is system-oriented in that it can be used with a wide range of different operating systems. When used in an aircraft, such as a helicopter, the backshell is grounded to the aircraft frame, and the conductor harness shields are grounded to the backshell. The window of unshielded conductor wires is minimal due to the use of the telescoping grounding elements. The spacing apart of the conductor-contacting ends of the circuit boards inside of the backshell provides enhanced protection against overheating in the backshell despite the small size of the backshell. As previously noted, if a system in the aircraft is changed, the backshell can be opened and different circuit boards can be inserted into the backshell. The interface assemblies can be bench tested, and once the prototype is debugged, all of the successive units are assured of proper operation due to the use of the circuit boards rather than individual conductor wires inside of the backshell. A wide variety of geometry interconnections can be made with this system, and round-to-rectangular interfaces are easily accomplished. Backshells which employ this invention may accommodate larger numbers of conductors in a smaller, lighter package. Space and weight are thus conserved, and the communications are sped up because of the reduced lengths of conductor inside of the backshell, as compared to the prior art.

Since many changes and variations of the disclosed embodiment of the invention may be made without departing from the inventive concept, it is not intended to limit the invention otherwise than as required by the appended claims.

What is claimed is:

1. An interface system for interconnecting multi-conductor bundle harnesses in a grounded environment, said system comprising:

a) an ambient-EMI shielding backshell which is grounded to said grounded environment;

b) an incoming multi-conductor bundle harness having an outer EMI shielding, a plurality of conductor wires shielded from ambient EMI by said outer shielding; and said conductor wires being shielded from inter-conductor EMI by inner individual EMI shields;

c) a housing which is grounded to one wall of said backshell, said housing forming a conduit through which stripped conductor wires pass into said backshell through said one wall thereof;

d) a ground ring surrounding said stripped conductor wires, said ground ring being telescoped inside of said housing and telescoped under stripped ends of said inner-EMI shields to ground said stripped inner EMI shields to said housing;

e) an inner ferrule telescoped over said ground ring and over said stripped ends of said inner EMI shields to force said stripped ends against said ground ring, said inner ferrule also being telescoped under a stripped end of said outer EMI shielding;

f) an outer ferrule telescoped over said inner ferrule and said stripped end of said outer EMI shielding to force the latter against said inner ferrule; and g) a strain relief member overlying said conductor bundle harness and securely secured to said housing to hold said outer ferrule, said inner ferrule and said ground ring tightly together and grounded to said backshell.

2. The interface system of claim 1 further comprising a plurality of semi-flexible circuit boards disposed in said backshell, said circuit boards containing internal shielded circuit lines which are electrically connected at one end to selected ones of said conductor wires, and which are connected at an opposite end to conductor pins or sockets which lead to an outlet connector on an outer surface of said backshell.

3. The interface system of claim 2 wherein said ends of said circuit boards are held spaced apart from each other within said backshell so as to provide for a heat-dissipating air gap between said circuit board ends to prevent overheating of said circuit board ends.

4. The interface system of claim 3 wherein said housing is connected to a first wall of said backshell which is perpendicular to a second wall of said backshell on which said outlet connector is mounted, and wherein said circuit boards have medial right angle flexed portions which accommodate a 90° offset of said outlet connector relative to said conductor bundle harness.

5. The interface system of claim 4 wherein said backshell includes a third wall which is spaced apart from and diagonal relative to said first and second walls, said third wall including an access opening sized to allow entry into and removal of said circuit boards from said backshell, said opening being selectively closed by a removable plate.

6. An interface system for interconnecting multi-conductor bundle harnesses in a grounded environment, said system comprising:

a) an ambient EMI-shielding backshell which is grounded to said grounded environment;

b) an incoming multi-conductor bundle harness having a plurality of conductor wires; an outer EMI shield to protect against ambient EMI; and individual inner EMI shields to protect against interconductor EMI;

c) means for grounding said inner and outer EMI shields to said backshell;

d) means for introducing unshielded portions of said conductor wires into said backshell through a first wall of said backshell;

e) means for providing an outlet connector on an outside surface of a second wall of said backshell, said means including conductive pins in said backshell adjacent to said second wall of said backshell; and f) a plurality of interconductor EMI-shielded semi-flexible circuit boards mounted in said backshell, said circuit boards having opposite endmost rigid conductor-connection ends and medial flexible portions, said rigid ends having a plurality of connection loci, each of which, at one end of said boards, is connected to at least one of said unshielded conductor wires from said incoming conductor bundle; and each of said connection loci at the other end of said boards is connected to at least one of said conductive pins.

7. The interface system of claim 6 wherein said first and second walls of said backshell are perpendicular to each other, and wherein said rigid ends of said circuit boards are parallel to a respective associated one of said backshell walls by reason of flexure of said medial portions of said circuit boards.

8. The interface system of claim 7 wherein said rigid ends of said circuit boards are fixed in said backshell in spaced apart positions relative to each other so as to provide a heat-dissipating air gap therebetween so as to protect against overheating of said connection loci.

9. The interface system of claim 6 wherein said means for grounding comprises:

a) a housing which is grounded to one wall of said backshell, said housing forming a conduit through which stripped portions of said conductor wires pass into said backshell through said one wall thereof;

b) a ground ring surrounding said stripped conductor wires, said ground ring being telescoped inside of said housing and telescoped between stripped ends of said inner-EMI shields to ground said stripped inner EMI shields to said housing;

c) an inner ferrule telescoped over said ground ring and over said stripped ends of said inner EMI shields to force said stripped ends against said ground ring, said inner ferrule also being telescoped under a stripped end of said outer EMI shielding; and d) an outer ferrule telescoped over said inner ferrule and said stripped end of said outer EMI shielding to force the latter against said inner ferrule.

* * * * *

UNITED STATES PATENT AND TRADEMARK OFFICE

CERTIFICATE OF CORRECTION

PATENT NO. : 5,244,417

DATED : September 14, 1993

INVENTOR(S) : Frederick A. Perretta, et al.

It is certified that error appears in the above-identified patent and that said Letters Patent is hereby corrected as shown below:

On title page, insert item [73]
Assignee: --United Technologies Corporation, Hartford, Connecticut--

Signed and Sealed this

Twelfth Day of April, 1994

Attest:

Bruce Lehman

BRUCE LEHMAN

Attesting Officer

Commissioner of Patents and Trademarks